United States Patent [19]

Possell et al.

[11] 4,050,636

[45] Sept. 27, 1977

[54] ENERGY SAVING GARBAGE DISPOSAL UNIT

[76] Inventors: Clarence R. Possell, 4842 Viane Way, San Diego, Calif. 92110; Robert J. Winkler, 2101 E. 4th St. No. 150, Santa Ana, Calif. 92704

[21] Appl. No.: 782,368

[22] Filed: Mar. 29, 1977

[51] Int. Cl.[2] ..... B02C 18/42

[52] U.S. Cl. ..... 241/46 B; 241/46.11; 241/100.5

[58] Field of Search ..... 241/46 R, 46 A, 46 B, 241/46.08, 46.11, 100.5, 257 G, DIG. 15; 415/90; 251/43

[56] References Cited

U.S. PATENT DOCUMENTS

| | | | |
|---|---|---|---|
| 696,135 | 3/1902 | Curtis | 251/43 |
| 1,174,656 | 3/1916 | Beckwith | 241/100.5 |
| 1,402,053 | 1/1922 | Dake | 415/90 |
| 1,445,310 | 2/1923 | Hall | 415/90 |
| 2,428,420 | 10/1947 | Green | 241/257 G |
| 2,508,583 | 5/1950 | Smith | 241/46.11 |
| 2,679,981 | 6/1954 | Eisinga | 241/100.5 |
| 2,832,546 | 4/1958 | Sprague | 241/100.5 |
| 3,674,237 | 7/1972 | Heyer et al. | 251/43 |

*Primary Examiner*—Granville Y. Custer, Jr.
*Attorney, Agent, or Firm*—William C. Babcock

[57] ABSTRACT

An energy saving garbage disposal unit that is disposed under a tank and connected to the drain thereof in a conventional manner. Actuation of the unit is provided by pressurized water from a domestic source thereof. Pressurized water entering the unit serves a twofold purpose; first, driving a turbine to actuate a garbage masticating assembly, and second, after discharge from the turbine the water mixing with masticated garbage and serving to flush the latter down a waste line that extends from the unit. The unit masticates garbage to particles of a predetermined size prior to discharging the particles to the waste line, with the possibility of the waste line becomming clogged or stopped up by garbage particles of substantial size being reduced to a minimum.

12 Claims, 11 Drawing Figures

FIG. 4
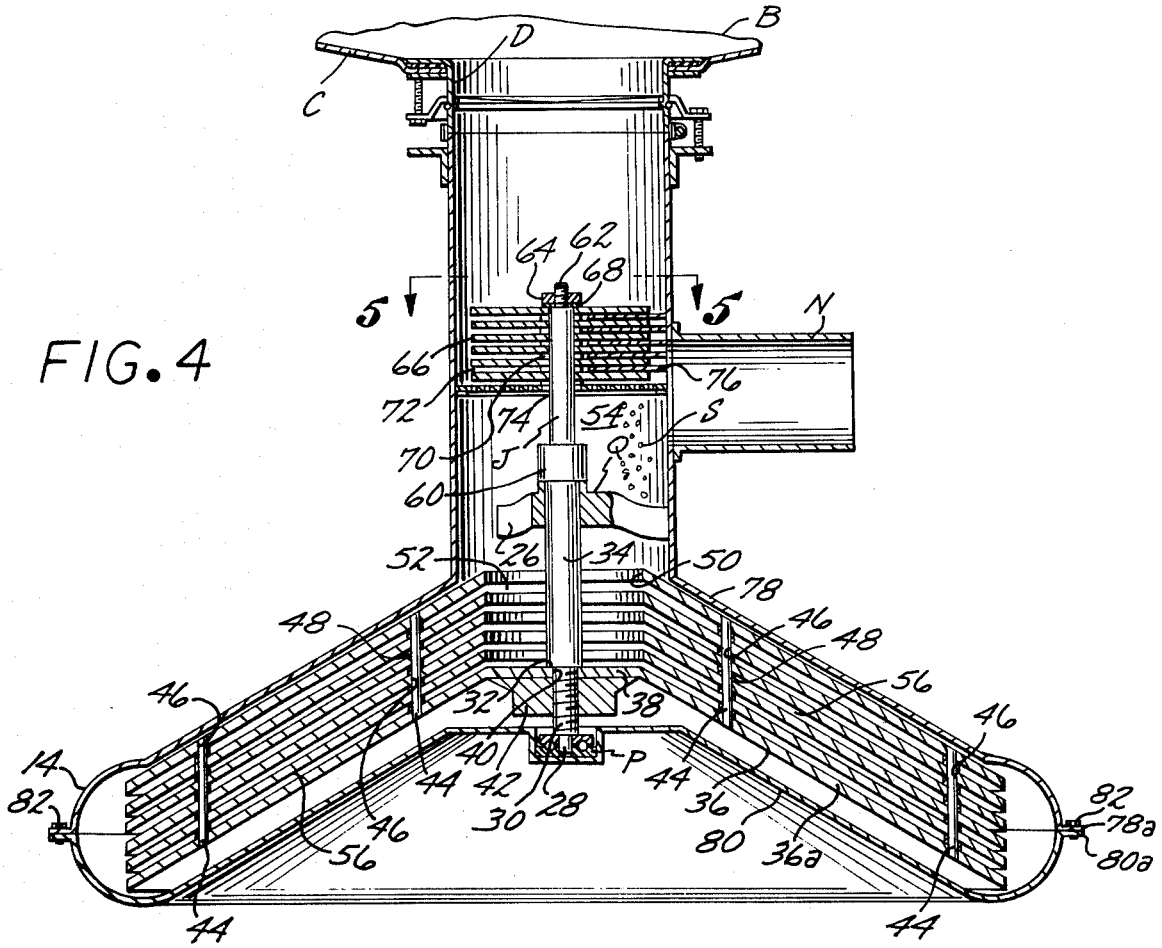
FIG. 5
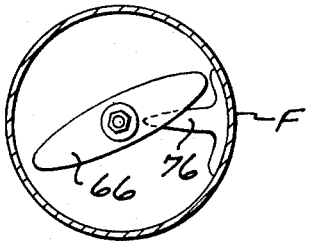
FIG. 6
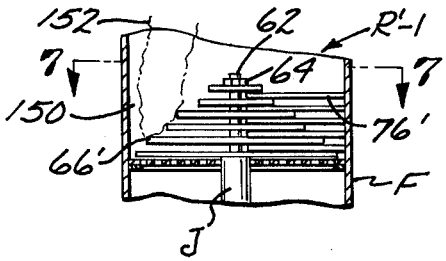
FIG. 7
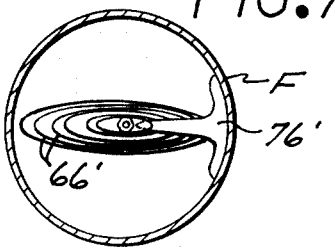
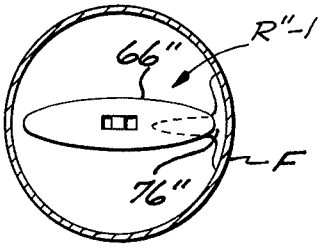
FIG. 8

ENERGY SAVING GARBAGE DISPOSAL UNIT

BACKGROUND OF THE INVENTION

1. Field of the Invention

Energy Saving Garbage Disposal Unit.

2. Description of the Prior Art

Electrically actuated garbage disposal units have become increasingly popular during the past few years. However, in numerous localities the installation of such units is discouraged or prohibited. In certain localities extensive electric wiring is required if such units are to be installed. In other locations, the units are prohibited from being installed on the ground that they unduly increase the electric load to which the utility serving that community is subjected.

A primary object in devising the present invention is to provide a garbage disposal unit that requires no electric energy, but is powered from a domestic source of pressurized water, with the pressurized water not only serving to power the unit, but to flush the masticated garbage down a waste line.

Another object of the invention is to not only provide a pressurized water actuated garbage disposal unit, but one that will reduce the garbage to masticated particles of not greater than a predetermined size, prior to the masticated garbage particles being discharged into a waste line, and with the assurance that due to the small size of the particles the waste line will not become clogged or stopped up as a result of such particles being discharged thereinto.

SUMMARY OF THE INVENTION

The energy saving garbage disposal unit includes a cylindrical shell disposed under a sink and connected to the drain thereof in a conventional manner. The shell is substantially vertically disposed and intermediate the upper and lower ends thereof has a waste line extending therefrom. A garbage masticating assembly is disposed in the shell above the waste line.

A shaft extends downwardly from the rotary part of the masticating assembly and on the lower end thereof is secured to a number of turbine discs that are separated from one another by radially extending spaces of a predetermined width. The turbine discs are rotatably supported within a circular confined space defined in a housing that depends from the lower end of the shell.

A number of circumferentially spaced nozzles extend inwardly through the periphery of the housing, with the nozzles being in communication with a manifold. The nozzles are adapted to discharge pressurized water from the manifold as a number of high velocity jets into the interior of the housing where the jets impinge on the turbine discs and are substantially tangential thereto. The manifold is in communication with a normally closed valve, which valve by conventional conduit means is connected to the source of pressurized water. The valve is preferably of a type in which the pressure of the water tending to flow therethrough tends to maintain the valve in a closed position, but with the valve assuming an open position when a small amount of pressurized water is allowed to bleed therefrom by use of a manual control. With the valve in the open position, pressurized water flows to the manifold to actuate the turbine. The jets of water after impinging on the turbine blades tend to flow through the radially extending spaces, and in so doing the water previously defining the jets tend to follow a spiral path at it loses velocity and has the pressure thereon increased. The water after pursuing the spiral path above-mentioned enters at least one set of axially aligned upwardly extending openings that are in communication with the interior of the shell. As the turbine discs are driven by kinetic energy imparted thereto by the high velocity jets of water, the rotating portion of the masticating assembly rotates and garbage as it moves downwardly through the shell being masticated. A perforated plate is situated directly under the masticating assembly, with the perforations in the plate only allowing garbage that has been reduced to particles of a predetermined size to pass downwardly therethrough to mix with water discharging upwardly from the turbine, and the mixture of masticated garbage and water flowing from the unit through the waste pipe previously mentioned. The perforated plate not only serves the function above-mentioned, but assures that garbage moving downwardly in the shell will not be disposed below the masticating assembly prior to the masticating operation being conducted. In this manner, the possibility of large chunks of unmasticated garbage moving into the waste line to possibly clog or completely stop the same is substantially eliminated. From the above summary, it will be seen that the pressurized water not only is used to power the unit and flush the masticated garbage down the waste line, but by the use of a valve of the type previously described, the pressurized water is also used to at least partially control the operation of the energy saving garbage disposal unit.

BRIEF DESCRIPTION OF THE DRAWING

FIG. 4 is a vertical cross-sectional view of the energy saving garbage disposal unit;

FIG. 5 is a fragmentary transverse cross-sectional view of the device taken on the line 5—5 of FIG. 4;

FIG. 6 is a side elevational view of a first alternate form of garbage masticating blades;

FIG. 7 is a combined transverse cross-sectional and top plan view of the shell and masticating assembly taken on the line 7—7 of FIG. 6;

FIG. 8 is a top plan view of a first alternate form of a garbage masticating blade;

DESCRIPTION OF THE PREFERRED EMBODIMENT

Figure 1:
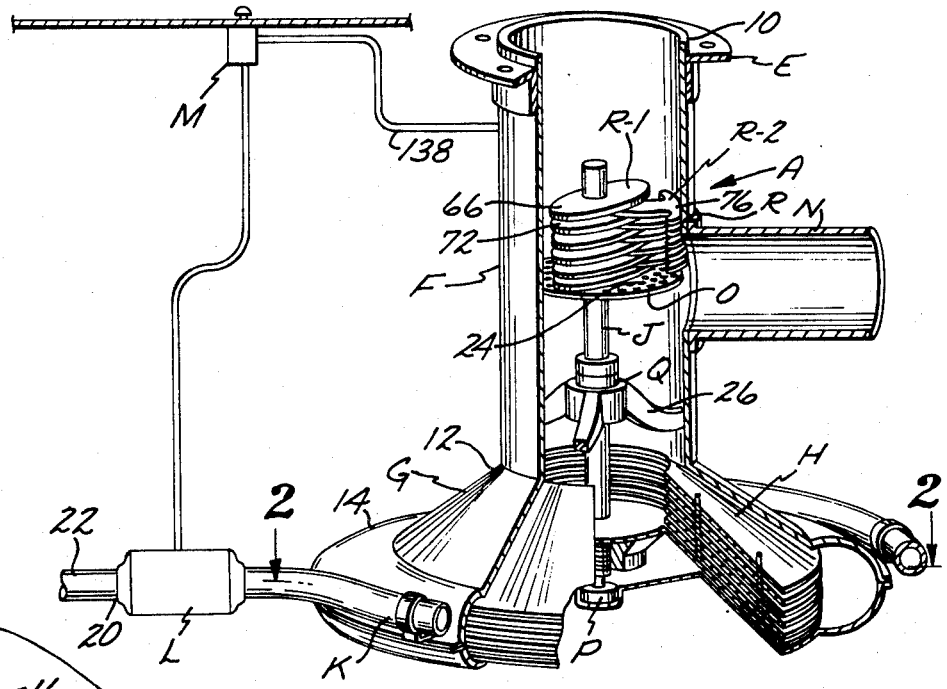
FIG. 1 is a perspective view of the energy saving garbage disposal unit and the pressurized water actuated valve used in controlling the operation thereof.

The energy saving garbage disposal unit A is illustrated in FIG. 4 as disposed below a conventional sink B having a bottom C in which a drain D is provided. A cylindrical shell F is substantially vertically disposed and situated under the drain D in axial alignment therewith. A clamp assembly E of conventional design maintains the shell F in communication with the drain D. The shell F has a first end 10 that is upwardly disposed and a second end 12 from which a housing G depends. The housing G has an outer periphery 14, and has a number of axially aligned and vertically spaced turbine discs H situated therein. The turbine discs H are mounted on the lower portion of a shaft J. A number of circumferentially spaced openings 16 are formed in the outer periphery 14 of the housing G, and a number of nozzles 18 are secured to the housing and extend through the openings 16.

Figure 2:
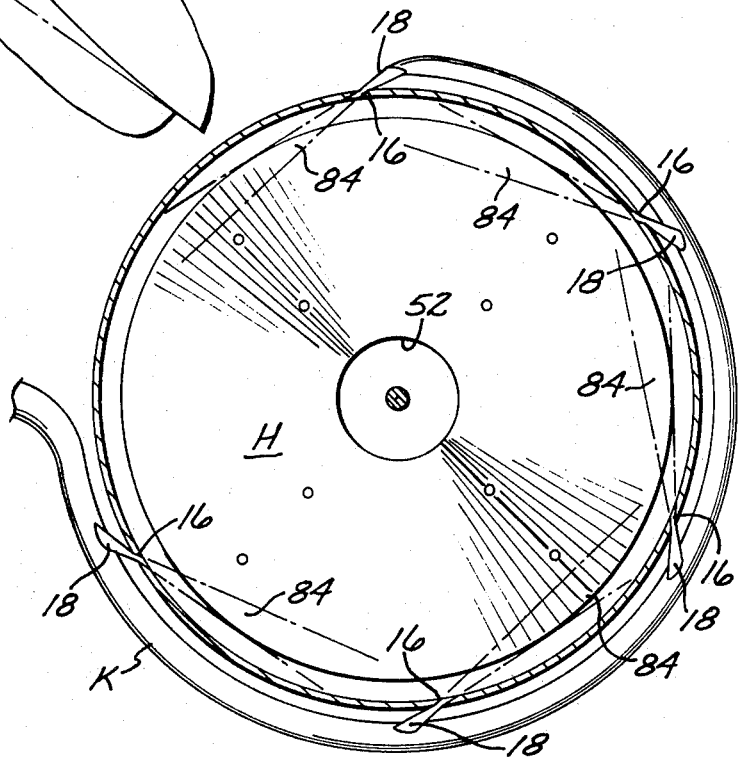
FIG. 2 is a fragmentary top plan view of the device taken on the line 2—2 of FIG. 1.

A housing conforming manifold K is provided as best seen in FIG. 2 that is in communication with a normally closed valve L, which valve may be selectively moved to either the closed or open position by a control assembly M. The shell F has a waste line N extending outwardly therefrom at a position intermediate the first and second ends of the shell. A rigid transverse plate O is supported with the confines of the shell F adjacent to the waste line N as shown in FIGS. 1 and 4, with this plate having a number of spaced openings 24 therein. The housing G is illustrated in FIG. 4 as supporting a bearing P that rotatably engages the lower end of an upwardly extending shaft J to which the turbine discs are rigidly secured. A bearing Q is situated within the interior of the shell F and is held in axial alignment with the bearing P by a spider 26 secured to the interior surface of the shell F. A garbage masticating assembly R is situated within the interior of the shell F adjacent with and extending above the waste line N as shown in FIGS. 1 and 4, with the assembly including a rotary portion R-1 that is driven by the shaft J and a stationary portion R-2 that is supported in an outwardly extending position from the interior surface of the shell F.

A conduit 22 extends from the valve L to a source of domestic water under substantial pressure, which source is not shown.

Shaft J has a lower portion 28 that rotataly engages bearing P. Shaft portion 28 depends from a threaded portion 30 of the shaft. The threaded portion 30 forms a body shoulder 32, with the part 34 of the shaft situated thereabove. A frusto-conical rigid tray 36 is provided that has a flat horizontal center portion 38 in which a centered bore 40 is formed, and through which bore threaded shaft portion 30 extends downwardly.

A nut 42 engages threaded shaft portion 30. When nut 42 is tightened, it cooperates with body shoulder 32 to grip center portion 38 of tray 36 therebetween, and hold the tray in a fixed non-rotatable position on shaft J.

The frusto-conical portion 36*a* of tray 36 has a number of circumferentially spaced bolts 44 extending upwardly therefrom, which bolts pass through aligned sets of openings 46 formed in turbine discs H. The turbine discs H are of frusto conical shape and are separated from one another by spacer 48 on bolts 44. The turbine discs H have axially aligned centered openings 50 therein that cooperate to define an upwardly extending passage 52 that is at all times in communication with the interior 54 of shell F and radially extending spaces 56 defined between adjoining turbine discs H. The bolts 44 may have upwardly disposed threaded ends that are engaged by nuts or other form of securing device, not important to the inventive concept as herein described. Shaft portion 34 preferably has a collar 60 thereon that is in rotatable contact with bearing Q. The upper part of shaft portion 34 above collar 60 is preferably of non-circular transverse cross-section. The shaft portion 34 on the upper end thereof develops into a threaded shaft portion 62 that is engaged by a nut 64.

The rotatable portion R-1 of masticating assembly R, is a number of elongate blades 66 that have centered openings 68 therein that conform to the non-circular transverse cross-section of the upper part of the shaft portion 34 on which they are mounted. Blades 66 have spacers 70 situated therebetween, which spacers engage the shaft above collar 60, and the blades being separated by transversely extending spaces 72. Blades 66 are prevented from moving downwardly on shaft J by a body plate 74 formed on the latter as shown in FIG. 4.

Portion R-2 of the masticating assembly R is a number of transverse blades 76 that extend outwardly from the interior surface from shell F, with the blades 76 so disposed and of such thickness as to pass through spaces 72 when masticating portion R-1 is rotated.

The outwardly disposed edges of blades 76 have the same radius of curvature as that of the interior surface of shell F, and to which surface the blades are bonded or secured by conventional means. At least a portion of the blades 76 preferably are disposed to span the entry opening into the waste line N, and are of sufficient length as to have end extremities of the outer edges thereof secured to the interior surface of shell F on opposite sides of the entry opening. The widths of the spaces 72 is preferably less than the diameters of the openings 24 for reasons that will later be explained.

The outer peripheral portion 14 of housing G is illustrated in the drawings as being semi-circular in transverse cross section. Housing G preferably includes upper and lower portions 78 and 80 that have outwardly extending aligned flanges 78*a* and 80*a* that are removably held together by bolts 82 or other suitable fastening means.

Housing G in transverse cross-section conforms generally to the transverse cross-section of the turbine discs H. Turbine discs H are preferably formed from a ceramic material such as silicon nitride, boron nitride or the like. Ceramic materials such as above-mentioned have substantial strength but are not resilient. To avoid flutter, when the turbine discs H rotate at high speed, and the possible fracture of the discs as a result thereof, the discs are preferably formed in frusto-conical shape.

Figure 3:
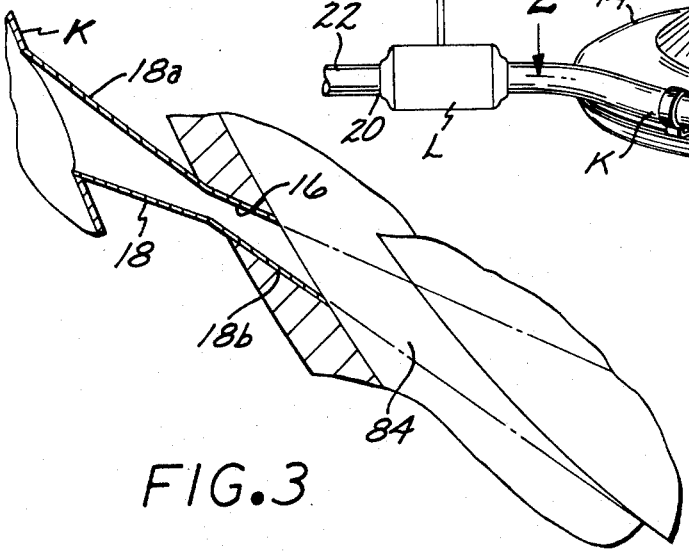
FIG. 3 is an enlarged fragmentary cross-sectional view of a portion of the housing illustrating one of the nozzles that is used therewith in forming a jet of high velocity water to impinge tangentially on the set of spaced turbine blades.

The manifold K as it progresses around housing 14, gradually decreases in internal transverse cross-section to the extent that pressurized water will be fed to nozzles 18 in such a manner that all of the nozzles will discharge jets of water 84 that are of the same velocity. The nozzles 18 have converging and diverging portions 18*a* and 18*b* as shown in FIG. 3. The jets 84 of high velocity water are of elongate shape and so oriented as to impinge on all of the turbine discs H substantially tangential thereto as shown in FIGS. 2 and 3.

The jets of water 84 enter the spaces 56 between the turbine discs H and thereafter lose velocity due to frictional resistance with the discs. The pressure on the water increases as the velocity decreases and as a result, the water pursues a spiral path prior to exiting from the discs through the passage 52. The pressurized water in flowing through spaces 56 imparts kinetic energy to the turbine discs H to drive the rotatable portion R-1 of masticating unit R. Flow of water under pressure to nozzles 18 is effected by manipulation of control assembly M.

When rotatable portion R-1 of masticating assembly R is driven, garbage (not shown) moving downwardly through shell F is masticated due to the corporative shredding action of the masticating portions R-1 and R-2. The garbage will continue to be shredded until it is reduced to particles of a size that will pass downwardly through openings 24 in plate O. However, plate O prevents garbage having particle sizes larger than openings 24 from moving downwardly below the masticating assembly R. Valve L includes an elongate hollow body 86 that has an internally threaded first end 88 that is closed by a threaded plug 90 that is connected to conduit 22. Plug 90 has a valve seat 92 on the inner end thereof. The valve seat is in communication with a passage 94 in the plug that connects with conduit 22. A second end 96 of body 86 is in communication with manifold K.

A spider 98 is disposed in body 86 and supports an elongate longitudinally extending member 100. Member 100 has a passage 102 that extends longitudinally therein, and communicates with a second passage 104 in the spider that leads to a conduit 106 that is connected to control unit M.

A cup-shaped valve member 108 is provided that includes a cylindrical side wall 110 and end piece 112. A resilient sealing ring 114 is mounted in a circular transverse recess 116 on member 100. Side wall 110 is slidably on member 100 and seals therewith due to ring 114.

A flat resilient seal 118 is held on the exterior surface of end piece 112 by an externally threaded member 120 that engages the tapped bore 122 formed in the end piece. Member 120 has a passage 124 with smaller diameter extending therethrough that communicates with a confined space 126 of variable volume defined within the valve member 108 as shown in FIG. 9.

Figure 9:
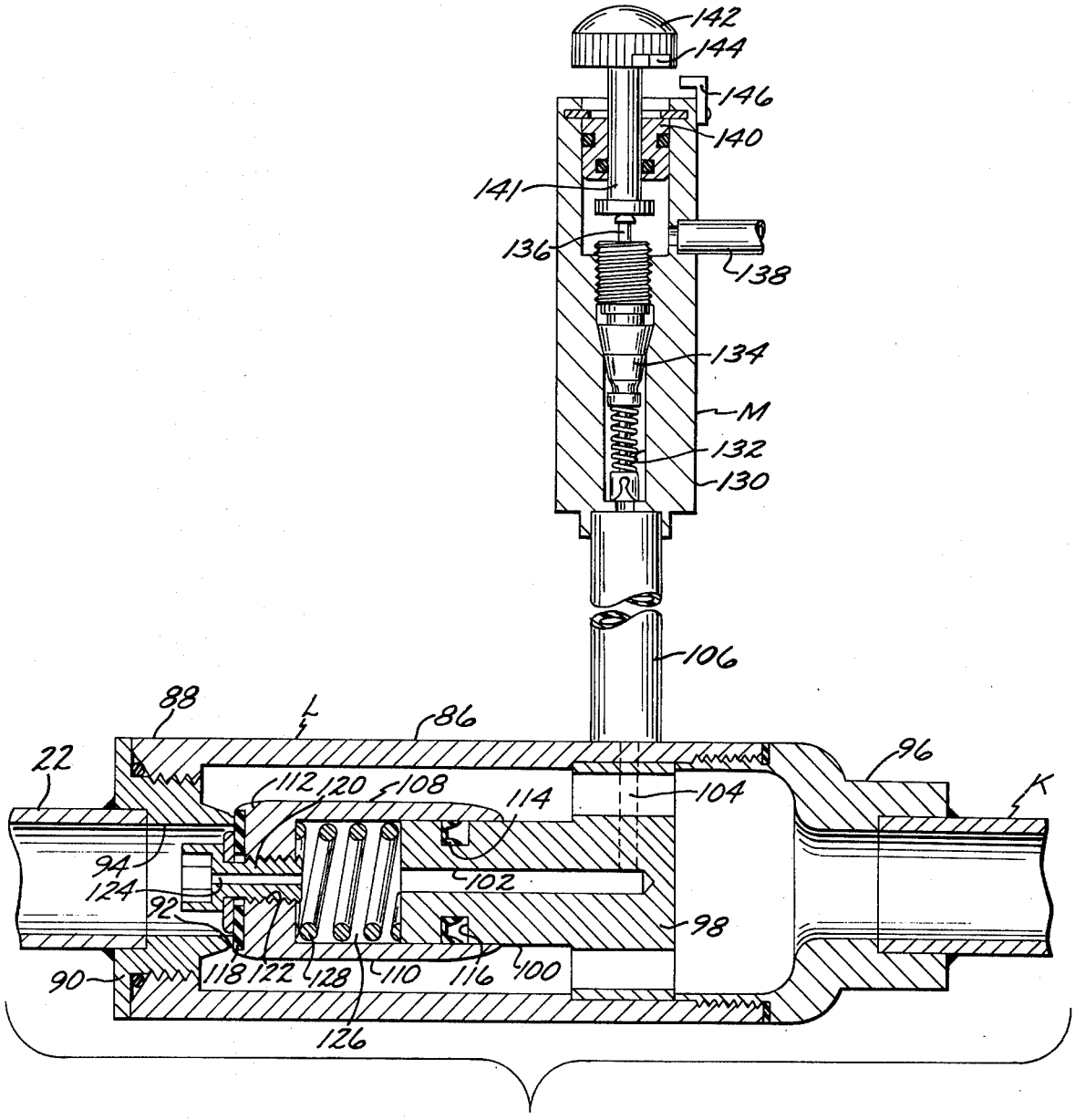
FIG. 9 is a vertical cross-sectional view of a first valve and a second valve used in controlling the flow of pressurized water to the energy saving garbage masticating unit.
Figure 10:
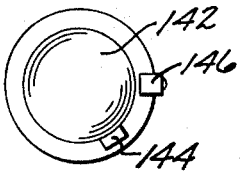
FIG. 10 is a top plan view of a second valve used in controlling the first valve shown in FIG. 9.
Figure 11:
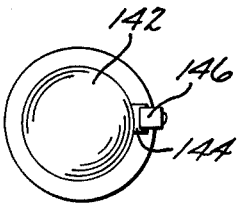
FIG. 11 is a second top plan view of the second valve, but with the handle thereof in a locked downwardly disposed second position.

When control assembly M is so disposed that water cannot flow from valve L through conduit 106, pressurized water will flow into confined space 126 and in cooperation with a compressed helical spring 128 in the confined space maintained valve member 108 in the first position as shown in FIG. 9.

The spring 128 does not by itself have sufficient strength to maintain valve member 108 in the first position against the force effected by pressurized water on the left hand side of seal 118 as viewed in FIG. 9.

The control assembly M includes an elongate rigid body 130 that has a longitudinal bore therein that is connected to a conduit 106. Bore 130 has a conventional pneumatic tire valve 134 therein, such as manufactured by the Shraeder Valve Company, that is spring-loaded and normally is in a closed position to prevent water flowing from conduit 106. Valve 134 includes a spring-loaded pin 136 which, when pressed downwardly as viewed in FIG. 9 opens control assembly M to permit flow of water therethrough to a conduit 138. Body 130 has a plug 140 sealingly mounted in the upper end thereof as shown in FIG. 9, which plug slidably supports a plunger 141 that has a handle 142 on the upper end thereof.

When plunger 140 is moved downwardly, the pin 138 is likewise moved downwardly, to open valve 134, and allow water from conduit 106 to flow to conduit 138. Flow of water in the above-described manner lessens the pressure of water in confined space 126, with valve member 108 now moving to the right as viewed in FIG. 9 to a second position. Pressurized water may now flow through valve V to manifold K to drive the garbage disposal unit A as previously described.

When manually exerted pressure is terminated on handle 142, the spring-loaded pin 136 returns valve 134 to a closed position. Water can no longer flow from conduit 106. Water now flows into confined space 126 to, in cooperation with spring 128, move valve member 108 to the left to occupy the first position as shown in FIG. 9. Flow of water through valve L to the manifold K is now terminated. Handle 142 is rotatable. The handle 142 has an undercut portion 144 thereon that is adapted to removably engage an L-shaped upwardly extending hook 146 when the handle is in a downwardly disposed position. The hook 146 is secured to the body 130 by conventional means.

In FIG. 6 an alternate form of rotatable masticating unit R'-1 is shown in which the rotatable blades 66' increase in length from the uppermost ones to the lowermost ones thereof. The blades of this configuration cooperation with the interior of the shell F to provide a downwardly extending confined space 150 in which the lowermost portion of garbage such as celery or corn cobs 152 will drop and be assured of being shredded. A second alternate form of blade structure R"-1 is shown in FIG. 8 in which the blade 66" has an elongate slot therein that engages a square, transverse, cross-sectional portion of the shaft 34 to move transversely when the first masticating portion R"-1 is being driven.

The operation of the preferred and first and second alternate forms of the invention in reducing garbage 152 which includes celery stocks, corn cobs and the like to particles S of a size that will become entrained with and carried by even a slow moving stream of water is as follows. When the button 142 is pressed downwardly the control assembly M allows water to flow to nozzles 18 where it is formed into jets 84 that impinge tangentially on the turbine discs H. Kinetic energy is imparted to the turbine discs H to cause the rotation thereof as well as portion R-1 of the garbage masticating assembly R.

Garbage 152 as it moves downwardly in shell F is sequentially positioned between the rotating portion R-1 and stationary portion R-2 of the garbage masticating unit to be chopped into particles S that are of sufficiently small size as to move downwardly through the openings 24 in plate O. To facilitate the chopping of the garbage 152 the leading edges of the blades in the rotating portion R-1 may be knife edges that slice through the garbage. Also, the lowermost surface of the lowest blade in the rotary portion R-1 as well as a desired number of the blades thereabove may taper downwardly and rearwardly from the leading edges thereof to effect a downward pumping action on water situated between it and the top surface of the plate O when the rotating portion R-1 rotates. Plate O is so situated relative to the rotating portion R-1 of the masticating assembly R that garbage 152 that has not been masticated cannot move an appreciable distance below the rotating portion.

When the turbine discs H are driven by water, the water discharges therefrom through passage 52 with sufficient velocity to impinge on the plate O, with a first portion of the water tending to flow upwardly through the openings 24 to mix with the particles S of garbage. A second portion of the water that contacts solid portions of the plate O will stay below the plate, and due to the volume of water discharging from passage 52 will flow to waste line N.

The particles of garbage S have a density greater than that of water, and will tend to move downwardly in the water above the plate. A first portion of the particles S above plate O will by the rotating action of the blades 66 be driven downwardly through the openings 24 to become entrained with the second portion of water and flow to the waste line N with it. A second portion of the particles S above plate O will be contacted by the rotating blades 66 and be driven by the blades through the spaces 72 into the waste line N. Irrespective of the paths the first and second portions of particles S follow their ultimate destination to waste line N. Rotation of the turbine discs H is terminated by allowing the button 142 to return to the up position.

Utilizing a maximum feed water pressure of 60.0 pounds per square inch (exemplary of the maximum water pressure in the Los Angeles, California area) it has been found that no-load speeds of shaft J in the area of 3,000 rpm have been found. In overall dimension, turbine discs H include approximately a 6 inch diameter dimension taken from the central axis of shaft J to a peripheral edge of turbine discs H. Presently, the vertical dimension of spaces 56 between discs H are being successfully used in the 1/16 14 ⅛ inch dimension range. Garbage disposal unit A is based on a continuous feed type unit. Obviously the width of spaces 56 must be related to the cross-section of axially aligned sets of openings formed through discs H in a manner to allow the pressurized water to be discharged into the inside of housing G at a lower rate than can be discharged from housing G. Thus, water can escape from the inside of housing G at a faster rate than it is discharged thereinto.

The structure of the garbage disposal unit A and the method of using the same has been previously described in detail and need not be repeated.

We claim:

1. A garbage disposal unit of the type that includes a cylindrical shell that has upper and lower ends and is disposed in a substantially vertical position below a drain opening in a sink and said upper end in communication with said drain opening, said shell having a masticated garbage outlet intermediate said upper and lower ends that is in communication with a waste line, said garbage disposal unit being characterized by being driven by pressurized water from a source thereof adjacent said unit including:

a. garbage masticating means in said cylindrical shell, said garbage masticating means including a first bladed rotatable portion and a second bladed stationary portion secured to the interior surface of said cylindrical shell, said second portion defining a plurality of transverse spaces through which said first bladed rotatable portion rotates, said masticating means positionally mounted adjacent and in communication with said waste line, a first portion of said garbage being masticated, passing from said masticating means and a second portion of said masticated garbage passing below said mastication means;

b. a housing displaced below said shell and in communication with said lower end thereof, said housing defining a circular confined space;

c. a plurality of axially aligned turbine discs rotatably supported in said circular confined space below said masticating means, said discs being frusto-conical in contour having at least one set of axially aligned openings formed therethrough, said frusto-conical contour defining an upward flow direction of water subsequent to said water interfacing with said turbine discs, said discs defining a plurality of radially extending spaces therebetween of sufficiently narrow width as to impose substantial drag on a stream of pressurized water flowing therethrough;

d. first means in communication with said source of pressurized water being coupled to said housing for providing at least one high velocity jet of water inside said housing that impinges on said turbine blades at an angle to subsequently flow through said radially extending spaces at a reduced velocity and an increased pressure to impart rotational energy to said turbine blades prior to exiting from said turbine blades through said axially aligned openings defined thereby, with said water after exiting through said opening flowing upwardly in said shell to said garbage masticating means to flush masticated garbage outwardly through said discharge opening, said exiting water to contact said first and second portions of said garbage for removal into said waste lines;

e. second means for transferring the rotational energy of said turbine blades to said first rotatable portion of said masticating means;

f. third means in said shell for preventing garbage that has not been masticated from moving downwardly in said shell substantially below said masticating means; and, g. fourth means operatively associated with said first means and manually operable to control the flow of water from said pressurized source of water to said circular confined space in said housing, said fourth means including a first valve in communication with said pressurized water, said housing and a second normally closed valve, said second valve being manually operable to control flow from said source through said first valve and into said housing.

2. A garbage disposal unit as defined in claim 1 in which said third means is a plate element having a plurality of holes formed therethrough, said plate element located in said cylindrical shell below said garbage masticating means.

3. A garbage disposal unit as defined in claim 2 in which said second means is a vertically extending shaft that is centered as to both said first masticating portion and said turbine discs and rigidly connected to both.

4. A garbage disposal unit as defined in claim 3 in which said first portion of said garbage masticating means is a plurality of first, transverse, longitudinally spaced blades secured to said shaft.

5. A garbage disposal unit as defined in claim 4 in which said second portion of said garbage masticating means is a plurality of second, transverse, blades rigidly secured to the interior of said shell in longitudinal spaced relationship, with said first blades rotating between said second blades with each rotation of said shaft, and the spaces between said second blades being of a width less than the diameter of said holes so that garbage will be masticated by said masticating means to particles that are sufficiently small as to move downwardly through said holes.

6. A garbage disposal unit as defined in claim 5 in which a portion of said second blades span said masticated garbage discharge opening, with said spaces between said second blades in communication with both the interior of said shell and said masticated garbage discharge opening, and a portion of the masticated garbage particles being discharged from the interior of said cylindrical shell to said masticated garbage outlet through said spaces between said second blades by contact with said first blades as the latter rotate.

7. A garbage disposal unit as defined in claim 3 in which said axially aligned turbine discs include:

h. a circular tray rigidly secured to said shaft and disposed inside said housing;

j. a plurality of circumferentially spaced pins that extend upwardly from said tray and pass through axially aligned sets of bores in said turbine discs;

k. A plurality of spacers on said pins for holding said turbine discs thereon to define said radially extending spaces between said turbine discs; and l. fifth means that engage the free extremities of said pins to hold said tray, pins and turbine discs together as an integral unit.

8. A garbage disposal unit as defined in claim 7 in which turbine discs are formed from a ceramic material to prevent corrosion thereof from moisture present inside said housing.

9. A garbage disposal unit as defined in claim 8 in which said turbine blades have said set of axially aligned openings therein located at the center thereof.

10. A garbage disposal unit as defined in claim 1 in which said fourth means first valve includes:

h. a hollow body that has first and second ends, said first end in communication with said source of pressurized water, and said second end with said first means for providing said jet of water inside of said housing, a valve seat inside said body adjacent said first end, and an outlet in said hollow body intermediate said first and second ends;

j. an elongate cup-shaped valve member longitudinally moveable in said housing and capable of occupying first and second positions therein, said valve member when in said first position sealing with said valve seat, said valve member having a longitudinal aperture therein;

k. an elongate longitudinal support in said body on which said valve member is slidably and sealingly mounted, said support having a passage therein in communication with said outlet, said valve member and support cooperating to define a confined space that is at all times in communication with said aperture and passage, with said confined space of such dimensions that when it is filled with pressurized water from said source said valve member is forced to said second position;

and said manually operated normally closed second valve in communication with said outlet, said second valve when displaced in an open position permitting said water in said confined space to flow therefrom and said valve member to said second position where said pressurized water flows through said first valve to said inside of said housing, and said second valve when closed causing pressurized water to fill said confined space to return said valve member to said first position.

11. A garbage disposal unit as defined in claim 1 in which the width of said radially extending spaces and the transverse cross-section of said axially aligned sets of openings is so related to the rate at which said pressurized water is discharged into said inside of said housing that water can escape from said inside of said housing at a rate faster than the rate at which it is discharged thereinto.

12. A garbage disposal unit as defined in claim 1 in which said first means discharges a plurality of circumferentially spaced jets of water into said inside of said housing.

* * * * *